US009210956B2

(12) United States Patent
Bolt et al.

(10) Patent No.: US 9,210,956 B2
(45) Date of Patent: Dec. 15, 2015

(54) ELECTROMAGNETIC FIELD REDUCTION BRASSIERE

(71) Applicants: Toni K. Bolt, West Babylon, NY (US); Anthony F. Bolt, West Babylon, NY (US)

(72) Inventors: Toni K. Bolt, West Babylon, NY (US); Anthony F. Bolt, West Babylon, NY (US)

( * ) Notice: Subject to any disclaimer, the term of this patent is extended or adjusted under 35 U.S.C. 154(b) by 0 days.

(21) Appl. No.: 14/077,076

(22) Filed: Nov. 11, 2013

(65) Prior Publication Data

US 2015/0133030 A1 May 14, 2015

(51) Int. Cl.
*A41C 3/00* (2006.01)
*A41D 31/00* (2006.01)

(52) U.S. Cl.
CPC ..... *A41C 3/005* (2013.01); *A41D 31/0016* (2013.01); *A41D 2400/32* (2013.01)

(58) Field of Classification Search
CPC ..... A41C 3/00; A41D 27/00; A41D 27/02; A41D 31/0066; A41D 31/0072; A41D 31/02
USPC ..... 450/92, 93, 39, 54–57, 36–38; 2/267, 2/268, 455
See application file for complete search history.

(56) References Cited

U.S. PATENT DOCUMENTS

| | | | | |
|---|---|---|---|---|
| 5,073,984 | A * | 12/1991 | Tone et al. | 2/457 |
| 5,115,140 | A * | 5/1992 | Rodriguez | 250/516.1 |
| 5,155,316 | A * | 10/1992 | Chiu | 219/634 |
| 5,244,708 | A * | 9/1993 | Tsuchida et al. | 428/77 |
| 5,621,188 | A | 4/1997 | Lee et al. | |
| 5,968,854 | A | 10/1999 | Akopian et al. | |
| 6,266,824 | B1 | 7/2001 | Giansanti | |
| 6,359,213 | B1 * | 3/2002 | Long | 174/388 |
| 6,488,564 | B1 * | 12/2002 | Gray | 450/57 |
| 6,665,877 | B1 | 12/2003 | Gray | |
| 6,814,647 | B1 * | 11/2004 | Huang | 450/39 |
| 8,246,416 | B2 | 8/2012 | Frye | |
| 8,308,489 | B2 | 11/2012 | Lee et al. | |
| 8,359,965 | B2 | 1/2013 | Oxford et al. | |
| 8,434,169 | B2 * | 5/2013 | Maner | 2/457 |
| 8,723,148 | B2 * | 5/2014 | Francois | 250/516.1 |
| 2010/0186155 | A1 * | 7/2010 | Maner | 2/466 |
| 2012/0228954 | A1 | 9/2012 | Kesler et al. | |
| 2013/0072777 | A1 | 3/2013 | Tremblay | |
| 2013/0098672 | A1 * | 4/2013 | Francois | 174/350 |

* cited by examiner

*Primary Examiner* — Gloria Hale
(74) *Attorney, Agent, or Firm* — Richard L. Miller

(57) ABSTRACT

As one implementation example, a product is described which comprises at least one protective layer. The at least one protective layer comprises an electromagnetic field resistant material. The at least one protective layer is adapted into at least a portion of a brassiere.

13 Claims, 1 Drawing Sheet

ELECTROMAGNETIC FIELD REDUCTION BRASSIERE

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relates to a protective brassiere. More particularly, the invention relates to a brassiere that protects against electromagnetic fields.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that an electromagnetic field is a physical field produced by electrically charged objects. It affects the behavior of charged objects in the vicinity of the field. Eddy currents are electric currents induced within conductors by a changing magnetic field in the conductor. These Eddy current fields cause repulsion to the electromagnetic field.

In many instances, a brassiere is a woman's undergarment that supports her breasts. Bras are typically form-fitting and perform a variety of functions and have also evolved into a fashion item. The primary purpose of a bra is to support the woman's breasts. Women commonly wear bras to conform to social norms such as a dress code, or because they believe bras prevent breasts from sagging.

Often, electromagnetic shielding is the practice of reducing the electromagnetic field in a space by blocking the field with barriers made of conductive or magnetic materials. Shielding is typically applied to enclosures to isolate electrical devices from external electromagnetic field sources, and to cables to isolate wires from the environment through which the cable runs.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
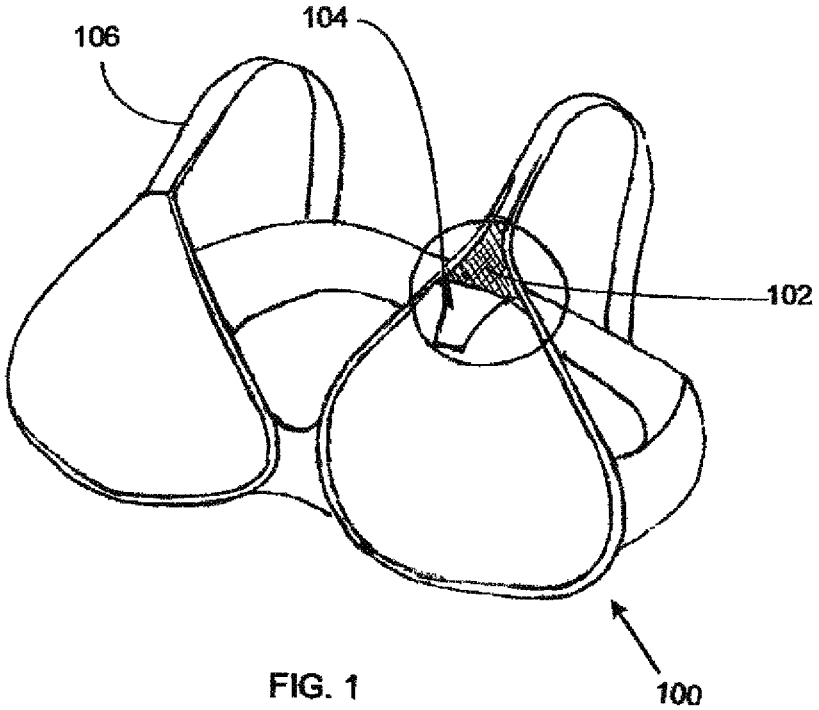
FIG. 1 illustrates a detailed perspective view of an exemplary protective garment, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present application or of any further application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

Headings provided herein are for convenience and are not to be taken as limiting the disclosure in any way.

The enumerated listing of items does not imply that any or all of the items are mutually exclusive, unless expressly specified otherwise.

The terms "a", "an" and "the" mean "one or more", unless expressly specified otherwise.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

It is noted that according to USA law, all claims must be set forth as a coherent, cooperating set of limitations that work in functional combination to achieve a useful result as a whole. Accordingly, for any claim having functional limitations interpreted under 35 USC §112 (6) where the embodiment in question is implemented as a client-server system with a remote server located outside of the USA, each such recited function is intended to mean the function of combining, in a logical manner, the information of that claim limitation with at least one other limitation of the claim. For example, in client-server systems where certain information claimed under 35 USC §112 (6) is/(are) dependent on one or more remote servers located outside the USA, it is intended that each such recited function under 35 USC §112 (6) is to be interpreted as the function of the local system receiving the remotely generated information required by a locally implemented claim limitation, wherein the structures and or steps which enable, and breathe life into the expression of such functions claimed under 35 USC §112 (6) are the corresponding steps and/or means located within the jurisdiction of the USA that receive and deliver that information to the client (e.g., without limitation, client-side processing and transmission networks in the USA). When this application is prosecuted or patented under a jurisdiction other than the USA, then "USA" in the foregoing should be replaced with the pertinent country or countries or legal organization(s) having enforceable patent infringement jurisdiction over the present application, and "35 USC §112 (6)" should be replaced with the closest corresponding statute in the patent laws of such pertinent country or countries or legal organization(s).

The present invention will now be described in detail with reference to embodiments thereof as illustrated in the accompanying drawings.

In a wireless age with unseen magnetic fields, the protective brassiere of the preferred embodiment at least partially shields against the exposure to electromagnetic fields incident on the breasts. The propagation of wireless signals are enabled by a varying electric/magnetic field. A varying magnetic field across closed loop conductive material produces Eddy currents. These Eddy currents will produce a magnetic field perpendicular to the imposed external field. The summation of both fields (external fields and magnetic fields generated by Eddy currents) results is a reduction or shielding to the external fields radiated through the conductive closed loop. This shielding effect may be efficacious in protecting against electromagnetic fields by, without limitation, reducing the coupling of electromagnetic fields incident on the body. In the preferred embodiment, the protected body part includes the breast or chest area. In this embodiment, the protective garment may include at least one emf resistant layer configured to at least partially shield against the transmission of electromagnetic fields.

One source of surrounding electromagnetic fields are wireless communications and are generated from wireless LAN protocols (such as Bluetooth), metropolitan area networks (such as WiMAX), global navigation satellite systems (GNSS), American global positioning system (GPS), mobile Broadband wireless (such as 3G/4G) and mobile phone networks (such as T-Mobile, Verizon, AT&T) to mention a few. Another source of surrounding electromagnetic fields are household appliances and electronic devices, such as the microwave oven, wireless television, computers and much more. Most of these electromagnetic fields operate in the 300 MHz to 6 GHz frequency range. The emf reduction brassiere will at least partially shield against frequencies up to 18 GHz. This covers all of the mentioned frequency and includes reduction to many satellite transmission bands (including C, X, and Ku frequency bands). Reduction to higher frequencies may also be achieved.

In one embodiment of the present invention, the protective garment may include a plurality of layers, each layer having unique and separate attributes. In some embodiments, at least one emf resistant protective layer may be fabricated to at least partially shield against the electromagnetic field. The at least one protective layer may include, without limitation, solid weaves, meshes, knit and non-woven materials. Various types of materials to shield from electromagnetic fields may be utilized, including, without limitation, nickel and copper coated polyester mesh, silver coated mesh, bamboo fiber and silver mesh, polyester/cotton blended with microfine stainless steel fibers, and a microwave absorbing carbon fabric. These materials are generally seen as efficacious because they are conductive. In other embodiments, numerous other combinations of materials may be used that are efficacious for blocking and shielding electromagnetic fields by Eddy currents, which are generated inside a conductor by varying currents to form magnetic fields which reduce the external magnetic fields incident on the body.

In one embodiment, the at least one protective layer may be overlaid by additional layers from each side. For example, without limitation, the at least one protective layer may be contained within the lining of a brasserie. In this manner, the protective garment may not necessitate inserts or external applications. In one embodiment, the protective layer is not comprised of inserts or external applications made up of a plurality of geometrically shaped objects. In some embodiments, the at least one protective layer may engage at least one inner layer. The at least one inner layer may be disposed to engage a body part, whereby the at least one protective layer rests outside the at least one inner layer. In some embodiments, at least one outer layer may be disposed to rest outside the at least one protective layer, whereby the at least one protective layer may be sandwiched between the at least one inner layer, and the at least one outer layer. However, in other embodiments, either the inner layer and/or the outer layer may not be utilized in the protective garment, or may be present in a plurality of layers. For example, without limitation, the protective garment may include one inner layer, one protective layer only, and no outer layer. The protective garment may also include a single or multi outer layer(s), a single or multi protective layer(s), and a single or multi inner layer (s). The outer and inner layer may be configured to allow for physical activity, absorbing perspiration, and repel moisture, while still providing comfort and emf shielding. Suitable outer and inner layer materials for this context may include, without limitation, polyester, nylon, lycra, and spandex to mention a few. These materials can be used to absorb or repel water, while at the same time providing support and being breathable. Suitable outer and inner layer materials for other contexts may also include, without limitation, cotton, satin, silk, or any other clothing fabric. In some embodiments, the at least one inner layer and outer layer may join the at least one protective layer through sewing. However, in other embodiments, the at least one inner layer may join with the at least one protective layer through various fastening means, including, without limitation, sewing, bonding, clipping, adhesives, hook and loop fasteners, buttons, zippers, and pins. A binding edge may help seal the various layers together. Any of the discussed layers may be sewable and machine washable.

FIG. 1 illustrates a detailed perspective view of an exemplary protective garment, in accordance with an embodiment of the present invention. In the present embodiment, the protective garment 100 may include an undergarment with emf resistant fabric 102 that at least partially shields against the transmission of electromagnetic fields. This shielding effect may be efficacious in protecting against electromagnetic fields by, without limitation, reducing the coupling of electromagnetic field incident on the covered body part. Those skilled in the art, in light of the present teachings, will recognize that Eddy currents are electric currents induced within conductors (contained within the emf resistant fabric) by an external changing magnetic field crossing or imposed on the conductor. These Eddy currents will produce a magnetic field perpendicular to the imposed external field. The summation of both fields (external fields and magnetic fields generated by Eddy currents) results in a reduction or shielding to the external fields radiated through the conductive closed loop. This shielding effect may be efficacious in protecting against electromagnetic fields by, without limitation, reducing the coupling of electromagnetic fields incident on the body. Most wireless communications and household appliances operate in the 300 MHz to 6 GHz frequency range. The emf reduction brassiere will at least partially shield against frequencies up to 18 GHz. This covers most of the communication frequency bands, household appliances and some satellite transmission frequency bands (including C, X, and Ku frequency bands). Fabrics with emf reduction to higher frequencies may be also be applied.

In some embodiments, a higher rate of shielding may be achieved through the use of a plurality of protective layers in the protective garment. For example, without limitation, a 30 dB reduction in the electromagnetic field is equivalent to the incident signal on a body area being reduced 1000 times. Similarly, a 60 dB reduction in the electromagnetic field is a signal reduced by 1 million times.

In the embodiment of the present invention, the undergarment includes a brassiere. An emf protective breast covering.

In one embodiment of the present invention, the protective garment may include a plurality of layers, each layer having unique and separate attributes. In some embodiments, at least one protective layer 102 may be fabricated to at least partially shield against the electromagnetic field. The at least one protective layer may include, without limitation, solid weaves, meshes, knit and non-woven materials. Various types of materials to shield from electromagnetic fields may be utilized, including, without limitation, nickel and copper coated polyester mesh, silver coated mesh, silver mesh, polyester/cotton blended with microfine stainless steel fibers, and a microwave absorbing carbon fabric. However, in other embodiments, numerous other combinations of materials may be used that are efficacious for blocking or shielding electromagnetic fields. The at least one protective layer may further include commercially available electromagnetic field shielding fabrics. The at least one protective layer may be sewable and machine washable.

In one embodiment, the at least one protective layer may be overlaid by additional layers from each side. For example, without limitation, the at least one protective layer may be contained within the lining of a brasserie. In this manner, the protective garment may not necessitate inserts or external applications. In one embodiment, the protective layer is not comprised of inserts or external applications made up of a plurality of geometrically shaped objects. In some embodiments, the at least one protective layer may engage at least one inner layer. The at least one inner layer may be disposed to engage a body part, whereby the at least one protective layer rests outside the at least one inner layer. In some embodiments, at least one outer layer 104 may be disposed to rest outside the at least one protective layer, whereby the at least one protective layer may be sandwiched between the at least one inner layer 302, and the at least one outer layer 104. However, in other embodiments, either the inner layer and/or the outer layer may not be utilized in the protective garment, or may be present in a plurality of layers. For example, without limitation, the protective garment may include one inner layer 302, one protective layer only 102, and no outer layer 104. The protective garment may also include single or multiple layers of each (102, 104, 302).

Figure 2:
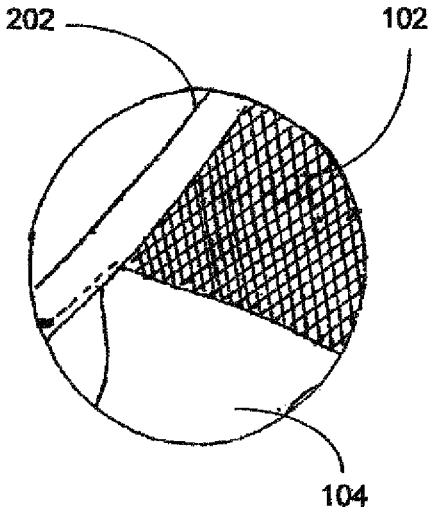
FIG. 2 illustrates a close up view of an exemplary protective garment, where an exemplary outer layer peels back from an exemplary protective layer, in accordance with an embodiment of the present invention.

FIG. 2 illustrates a close up view of an exemplary protective garment, where an exemplary outer layer peels back form an exemplary protective layer, in accordance with an embodiment of the present invention. In the present embodiment, the at least one outer layer, and the at least one inner layer may sandwich the at least one protective layer. In some embodiments, the outer and inner layer may be configured to allow for physical activity, absorbing perspiration, and repelling moisture from the protective garment, yet still providing comfort and shielding of electromagnetic fields. Suitable materials for the outer and inner layers may include, without limitation, cotton, satin, silk polyester, nylon, lycra, spandex, or any other clothing fabric. In some embodiments, the at least one inner layer and outer layer may join the at least one protective layer through sewing. However, in other embodiments, the at least one inner layer may join with the at least one protective layer through various fastening means, including, without limitation, sewing, bonding, clipping, adhesives, hook and loop fasteners, buttons, zippers, and pins. The layers may be sewn together, or a binding edge 202 may help seal the various layers together. Any of the discussed layers may be machine washable.

Figure 3:
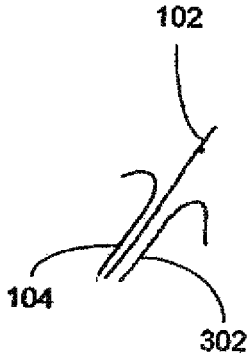
FIG. 3 illustrates a side view of an exemplary outer layer, an exemplary protective layer, and an exemplary inner layer, in accordance with an embodiment of the present invention.

FIG. 3 illustrates a side view of an exemplary outer layer, an exemplary protective layer, and an exemplary inner layer, in accordance with an embodiment of the present invention. In the present embodiment, the at least one protective layer may be overlaid by additional layers from each side. For example, without limitation, the at least one protective layer may be contained within the lining of a brasserie. In this manner, the protective garment may not necessitate inserts or external applications. In one embodiment, the protective layer is not comprised of inserts or external applications made up of a plurality of geometrically shaped objects. In some embodiments, the at least one protective layer may engage at least one inner layer 302. The at least one inner layer may be disposed to engage a body part, whereby the at least one protective layer rests outside the at least one inner layer. In some embodiments, at least one outer layer 104 may be disposed to rest outside the at least one protective layer, whereby the at least one protective layer may be sandwiched between the at least one inner layer contacting the body, and the at least one outer layer. However, in other embodiments, either the inner layer and/or the outer layer may not be utilized in the protective garment, or may be present in a plurality of layers. For example, without limitation, the protective garment may include one inner layer, one protective layer only, and no outer layer. The protective garment may also include single or multiple layers of each (102, 104, 302).

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC §112 (1), all claims must be supported by sufficient disclosure in the present patent specification, and any material known to those skilled in the art need not be explicitly disclosed. However, 35 USC §112 (6) requires that structures corresponding to functional limitations interpreted under 35 USC §112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC §112 (6) when such corresponding structures are not explicitly disclosed in the foregoing patent specification. Therefore, for any invention element(s)/structure(s) corresponding to functional claim limitation(s), in the below claims interpreted under 35 USC §112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC §112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC §112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC §112 (6). Applicant(s) note that all the identified documents above which are incorporated by reference to satisfy 35 USC §112 (6) necessarily have a filing and/or publication date prior to that of the instant application, and thus are valid prior documents to incorporated by reference in the instant application.

Having fully described at least one embodiment of the present invention, other equivalent or alternative methods of implementing a multilayered brassiere that protects against electromagnetic fields according to the present invention will be apparent to those skilled in the art. Various aspects of the invention have been described above by way of illustration, and the specific embodiments disclosed are not intended to limit the invention to the particular forms disclosed. The particular implementation of the multilayered garment that protects against electromagnetic fields may vary depending upon the particular context or application. By way of example, and not limitation, the multilayered undergarment that protects against electromagnetic fields described in the foregoing were principally directed to a brassiere with a protective layer that shields against electromagnetic fields, and is sandwiched between two fabrics sewn in implementations. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The Abstract is provided to comply with 37 C.F.R. Section 1.72(*b*) requiring an abstract that will allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A brassiere comprising:

a) at least one protective layer comprising an electromagnetic field resistant material;

b) at least one inner layer of clothing fabric engaged with an inside of said at least one protective layer;

c) at least one outer layer of clothing fabric engaged with an outside of said at least one protective layer; and d) a binding edge to help seal said at least one protective layer, the at least one inner layer, and the at least one outer layer;

wherein said at least one protective layer is adapted to be engaged with or formed as at least a portion of said brassiere.

2. The brassiere of claim 1, wherein said at least one protective layer is sewable sewn within an inner lining of said brassiere.

3. The brassiere of claim 1, wherein said electromagnetic field resistant material is sewable and washable.

4. The brassiere of claim 1, wherein said electromagnetic field resistant material is a solid weave, mesh, knit, or non-woven material.

5. The brassiere of claim 1, wherein said electromagnetic field resistant material is a silver mesh.

6. The brassiere of claim 1, wherein the clothing fabric comprises cotton, satin, silk, polyester, nylon, or spandex.

7. The brassiere of claim 1, wherein said at least one protective layer enables at least partial protection from electromagnetic fields in the range of at least up to 18 GHz.

8. The brassiere of claim 1, wherein said at least one protective layer, the at least one inner layer, and the at least one outer layer, are coupled into engagement by fastening means.

9. The brassiere of claim 1, wherein said at least one protective layer does not comprises inserts or external applications made up of a plurality of geometrically shaped objects.

10. A brassiere comprising:

a) at least one protective layer comprising an electromagnetic field resistant material, wherein said at least one protective layer is adapted to form a brassiere, and wherein said at least one protective layer enables at least partial protection from electromagnetic fields in the range of at least up to 18 Ghz;

b) at least one inner layer of clothing fabric engaged with an inside of said at least one protective layer;

c) at least one outer layer of clothing fabric engaged with an outside of said at least one protective layer; and d) a binding edge to help seal said at least one protective layer, the at least one inner layer, and the at least one outer layer.

11. The brassiere of claim 10, wherein said at least one protective layer does not comprises inserts or external applications made up of a plurality of geometrically shaped objects.

12. A brassiere comprising:

a) a protective layer for protecting a body from electromagnetic fields;

b) a clothing layer engaged with said protective layer for providing comfortable contact with the body;

c) a fastening means for fastening the protective layer and the clothing layer together; and d) a binding edge for scaling the protective layer and the clothing layer.

13. The brassiere of claim 12, wherein said protective layer and the clothing layer are adapted to form a brassiere.

* * * * *